US010494932B2

(12) United States Patent
Jones

(10) Patent No.: US 10,494,932 B2
(45) Date of Patent: Dec. 3, 2019

(54) TURBOMACHINE ROTOR BLADE COOLING PASSAGE

(71) Applicant: General Electric Company, Schenectady, NY (US)

(72) Inventor: Mark Andrew Jones, Ponte Vedra Beach, FL (US)

(73) Assignee: General Electric Company, Schenectady, NY (US)

( * ) Notice: Subject to any disclaimer, the term of this patent is extended or adjusted under 35 U.S.C. 154(b) by 296 days.

(21) Appl. No.: 15/426,170

(22) Filed: Feb. 7, 2017

(65) Prior Publication Data

US 2018/0340428 A1 Nov. 29, 2018

(51) Int. Cl.
*F01D 5/20* (2006.01)
*F01D 5/18* (2006.01)

(52) U.S. Cl.
CPC ..... *F01D 5/20* (2013.01); *F01D 5/187* (2013.01); *F05D 2220/32* (2013.01); *F05D 2240/24* (2013.01); *F05D 2240/307* (2013.01); *F05D 2260/20* (2013.01)

(58) Field of Classification Search
CPC ..... F01D 5/20; F01D 5/187; F01D 2220/32; F01D 2240/24; F01D 2240/307; F05D 2260/20
USPC ..... 415/115
See application file for complete search history.

(56) References Cited

U.S. PATENT DOCUMENTS

| | | | | |
|---|---|---|---|---|
| 4,390,320 | A * | 6/1983 | Eiswerth | F01D 5/005 29/889.1 |
| 7,537,431 | B1 * | 5/2009 | Liang | F01D 5/187 415/115 |
| 9,371,741 | B2 * | 6/2016 | Ito | F01D 5/187 |
| 2001/0048878 | A1 * | 12/2001 | Willett | F01D 5/182 416/97 R |
| 2004/0022633 | A1 * | 2/2004 | Kraft | F01D 5/18 416/191 |
| 2010/0196160 | A1 * | 8/2010 | Hudson | B22C 9/103 416/95 |
| 2012/0020805 | A1 * | 1/2012 | Suciu | F01D 5/147 416/241 R |
| 2013/0142649 | A1 * | 6/2013 | Collier | F01D 5/187 416/1 |
| 2015/0064010 | A1 | 3/2015 | Zhang et al. | |
| 2018/0230806 | A1 * | 8/2018 | Zemitis | F01D 5/20 |
| 2018/0230816 | A1 * | 8/2018 | Zemitis | F01D 5/20 |
| 2018/0340428 | A1 * | 11/2018 | Jones | F01D 5/20 |

* cited by examiner

*Primary Examiner* — Mahmoud Gimie
(74) *Attorney, Agent, or Firm* — Dority & Manning, P.A.

(57) ABSTRACT

The present disclosure is directed to a rotor blade for a turbomachine. The rotor blade includes an airfoil and a tip shroud coupled to the airfoil. The tip shroud defines a core. The tip shroud includes a rib positioned within the core and a radially outer wall. The rib separates a first portion of the core and a second portion of the core. The airfoil, the rib, and the radially outer wall partially define a first cooling passage fluidly isolated from the core.

20 Claims, 6 Drawing Sheets

TURBOMACHINE ROTOR BLADE COOLING PASSAGE

FIELD

The present disclosure generally relates to turbomachines. More particularly, the present disclosure relates to rotor blade cooling passages for turbomachines.

BACKGROUND

A gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

The turbine section generally includes a plurality of rotor blades. Each rotor blade includes an airfoil positioned within the flow of the combustion gases. In this respect, the rotor blades extract kinetic energy and/or thermal energy from the combustion gases flowing through the turbine section. Certain rotor blades may include a tip shroud coupled to the radially outer end of the airfoil. The tip shroud reduces the amount of combustion gases leaking past the rotor blade.

The rotor blades generally operate in extremely high temperature environments. As such, the airfoil and tip shroud of each rotor blade may define various passages, cavities, and apertures through which cooling fluid may flow. For example, one or more cooling passages may extend through the airfoil to supply the cooling fluid to a core in the tip shroud. The cooling fluid then exits the core through one or more outlet apertures in the tip shroud. All cooling fluid flowing to the tip shroud may be directed to the core. Nevertheless, the outlet apertures in the tip shroud create back pressure in the rotor blade, which reduce the velocity of the cooling fluid flowing therethrough. This reduced velocity may limit the cooling provided to certain portions of the airfoil.

BRIEF DESCRIPTION

Aspects and advantages of the technology will be set forth in part in the following description, or may be obvious from the description, or may be learned through practice of the technology.

In one aspect, the present disclosure is directed to a rotor blade for a turbomachine. The rotor blade includes an airfoil and a tip shroud coupled to the airfoil. The tip shroud defines a core. The tip shroud includes a rib positioned within the core and a radially outer wall. The rib separates a first portion of the core and a second portion of the core. The airfoil, the rib, and the radially outer wall partially define a first cooling passage fluidly isolated from the core.

In another aspect, the present disclosure is directed to a turbomachine including a compressor section, a combustion section, and a turbine section. The turbine section includes one or more rotor blades. Each rotor blade includes an airfoil and a tip shroud coupled to the airfoil. The tip shroud defines a core. The tip shroud includes a rib positioned within the core and a radially outer wall. The rib separates a first portion of the core and a second portion of the core. The airfoil, the rib, and the radially outer wall partially define a first cooling passage fluidly isolated from the core.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
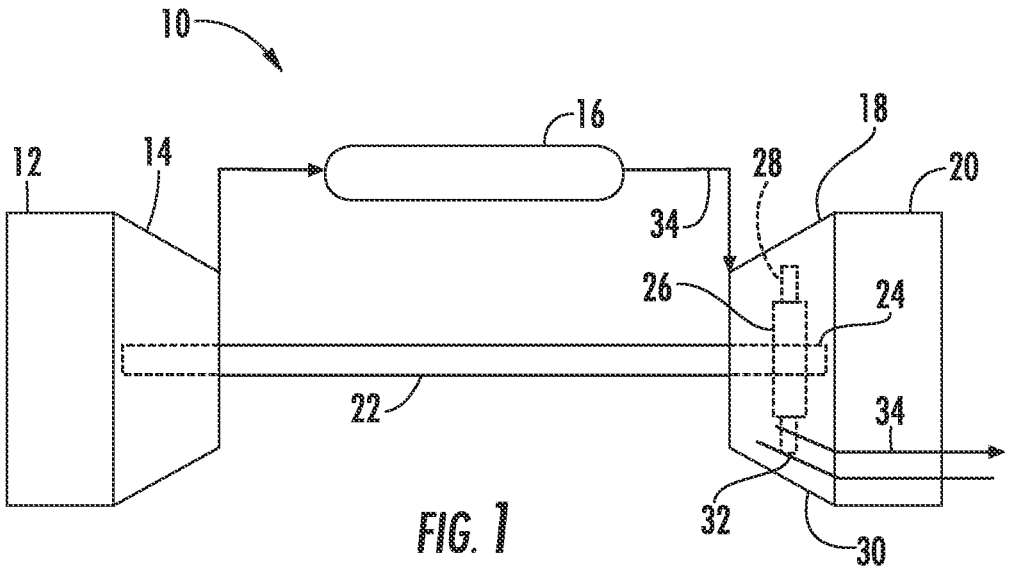
FIG. 1 is a schematic view of an exemplary gas turbine engine in accordance with the embodiments disclosed herein.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, wherein identical numerals indicate the same elements throughout the figures, FIG. 1 schematically illustrates a gas turbine engine 10. It should be understood that the gas turbine engine 10 of the present disclosure need not be a gas turbine engine, but rather may be any suitable turbomachine, such as a steam turbine engine or other suitable engine. The gas turbine engine 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may generally include a rotor shaft 24 having a plurality of rotor disks 26 (one of which is shown) and a plurality of rotor blades 28 extending radially outward from and being interconnected to the rotor disk 26. Each rotor disk 26, in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, air or another working fluid flows through the inlet section 12 and into the compressor section 14, where the air is progressively compressed to provide pressurized air to the combustors (not shown) in the combustion section 16. The pressurized air mixes with fuel and burns within each combustor to produce combustion gases 34. The combustion gases 34 flow along the hot gas path 32 from the combustion section 16 into the turbine section 18. In the turbine section, the rotor blades 28 extract kinetic and/or thermal energy from the combustion gases 34, thereby causing the rotor shaft 24 to rotate. The mechanical rotational energy of the rotor shaft 24 may then be used to power the compressor section 14 and/or to generate electricity. The combustion gases 34 exiting the turbine section 18 may then be exhausted from the gas turbine engine 10 via the exhaust section 20.

Figure 2:
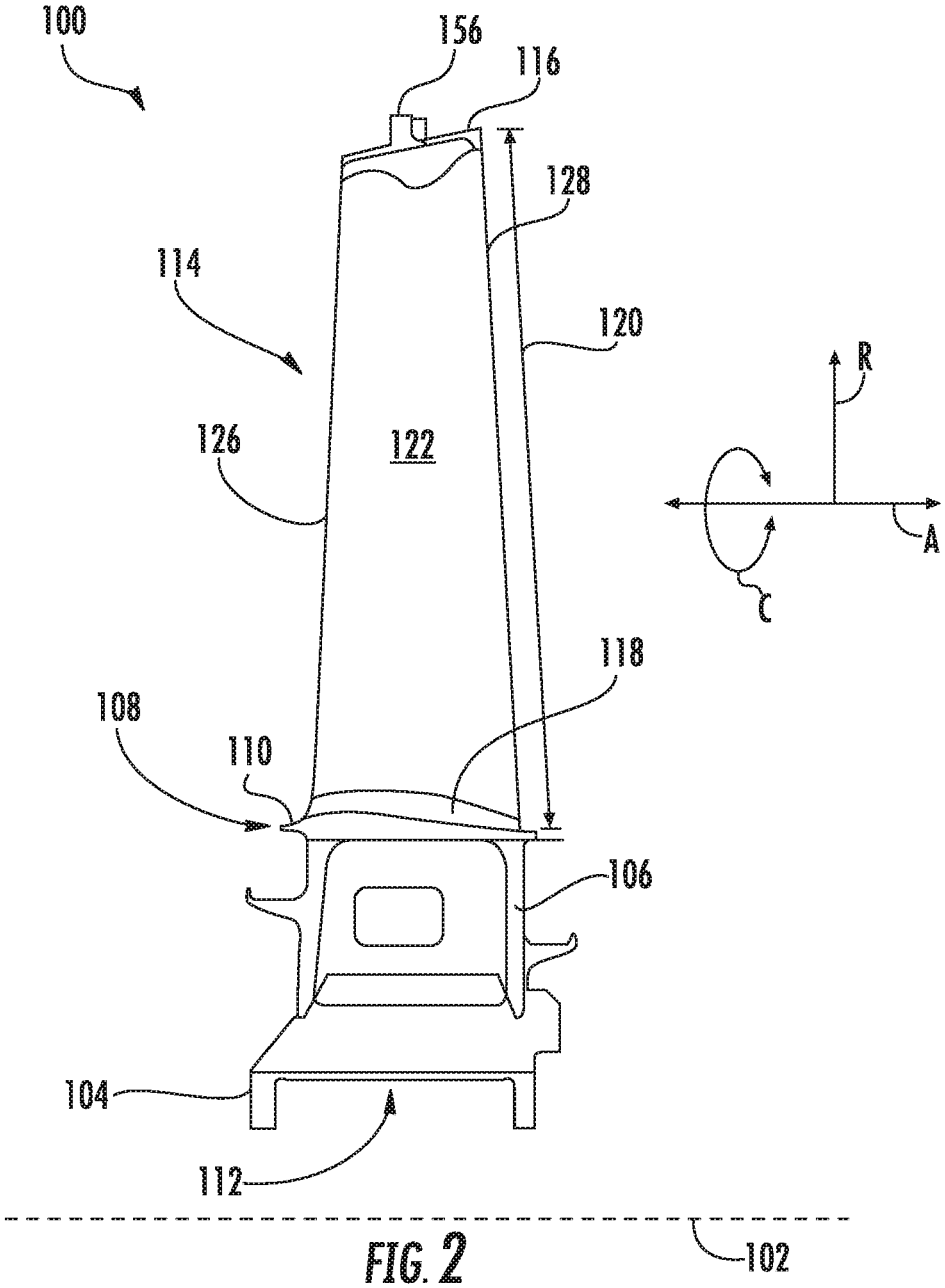
FIG. 2 is a front view of an exemplary rotor blade in accordance with the embodiments disclosed herein.

FIG. 2 is a view of an exemplary rotor blade 100, which may be incorporated into the turbine section 18 of the gas turbine engine 10 in place of the rotor blade 28. As shown, the rotor blade 100 defines an axial direction A, a radial direction R, and a circumferential direction C. In general, the axial direction A extends parallel to an axial centerline 102 of the shaft 24 (FIG. 1), the radial direction R extends generally orthogonal to the axial centerline 102, and the circumferential direction C extends generally concentrically around the axial centerline 102. The rotor blade 100 may also be incorporated into the compressor section 14 of the gas turbine engine 10 (FIG. 1).

As illustrated in FIG. 2, the rotor blade 100 may include a dovetail 104, a shank portion 106, and a platform 108. More specifically, the dovetail 104 secures the rotor blade 100 to the rotor disk 26 (FIG. 1). The shank portion 106 couples to and extends radially outward from the dovetail 104. The platform 108 couples to and extends radially outward from the shank portion 106. The platform 108 includes a radially outer surface 110, which generally serves as a radially inward flow boundary for the combustion gases 34 flowing through the hot gas path 32 of the turbine section 18 (FIG. 1). The dovetail 104, shank portion 106, and platform 108 may define an intake port 112, which permits cooling fluid (e.g., bleed air from the compressor section 14) to enter the rotor blade 100. In the embodiment shown in FIG. 2, the dovetail 104 is an axial entry fir tree-type dovetail. Alternately, the dovetail 104 may be any suitable type of dovetail. In fact, the dovetail 104, shank portion 106, and/or platform 108 may have any suitable configurations.

Figure 3:
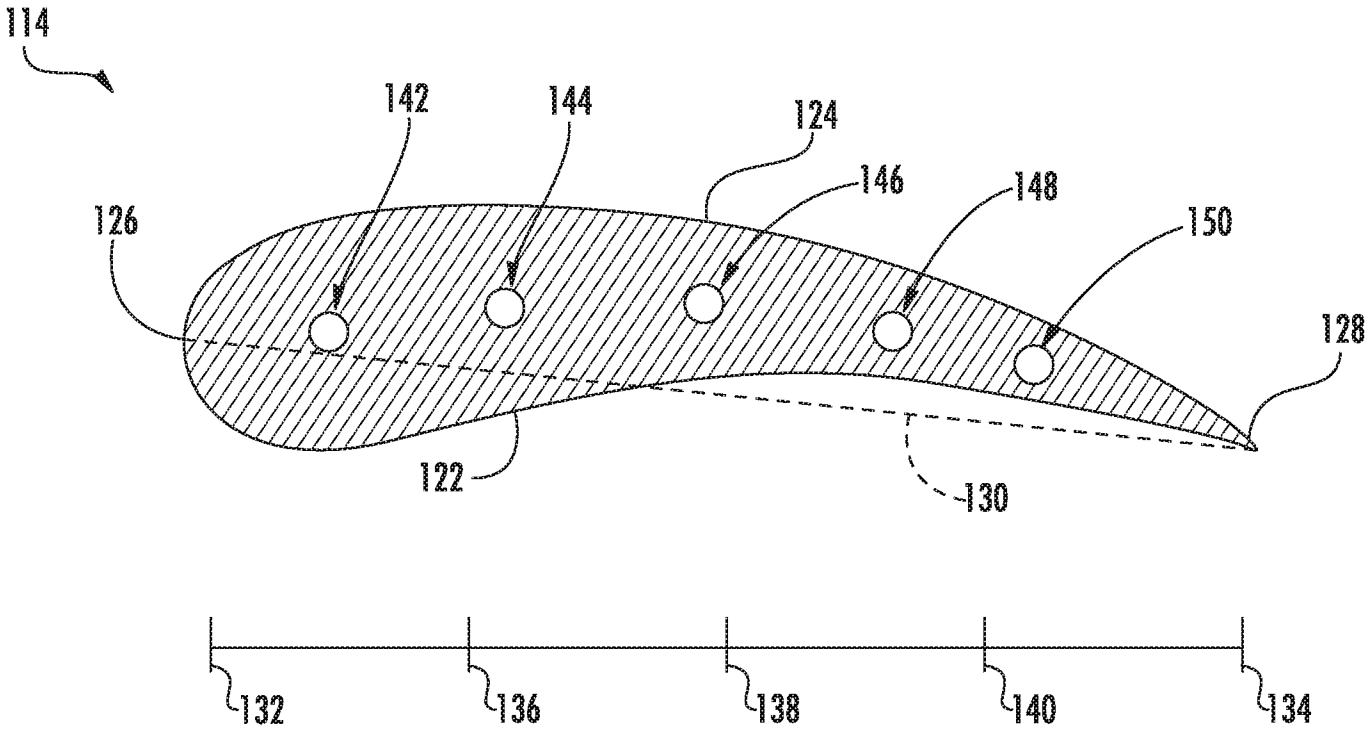
FIG. 3 is a cross-sectional view of an exemplary airfoil in accordance with the embodiments disclosed herein.

Referring now to FIGS. 2 and 3, the rotor blade 100 further includes an airfoil 114. In particular, the airfoil 114 extends radially outward from the radially outer surface 110 of the platform 108 to a tip shroud 116. The airfoil 114 couples to the platform 108 at a root 118 (i.e., the intersection between the airfoil 114 and the platform 116). In this respect, the airfoil 118 defines an airfoil span 120 extending between the root 118 and the tip shroud 116. The airfoil 114 also includes a pressure side surface 122 and an opposing suction side surface 124 (FIG. 3). The pressure side surface 122 and the suction side surface 124 are joined together or interconnected at a leading edge 126 of the airfoil 114, which is oriented into the flow of combustion gases 34 (FIG. 1). The pressure side surface 122 and the suction side surface 124 are also joined together or interconnected at a trailing edge 128 of the airfoil 114 spaced downstream from the leading edge 126. The pressure side surface 122 and the suction side surface 124 are continuous about the leading edge 126 and the trailing edge 128. The pressure side surface 122 is generally concave, and the suction side surface 124 is generally convex.

Referring now to FIG. 3, the airfoil 114 defines a chord 130. More specifically, the chord 130 extends from the leading edge 126 to the trailing edge 128. In this respect, the leading edge 126 is positioned at zero percent of the chord 130, and the trailing edge 128 is positioned at one hundred percent of the chord 130. As shown, zero percent of the chord 130 is identified by 132, and one hundred percent of the chord 130 is identified by 134. Furthermore, twenty-five percent of the chord 130 is identified by 136, fifty percent of the chord 130 is identified by 138, and seventy-five percent of the chord 130 is identified by 140.

The airfoil 114 partially defines a plurality of cooling passages extending therethrough. In the embodiment shown in FIG. 3, the airfoil 114 partially defines cooling passages 142, 144, 146, 148, 150. In alternate embodiments, however, the airfoil 114 may define more or fewer cooling passages. The cooling passages 142, 144, 146, 148, 150 extend radially outward from the intake port 112 through the airfoil 114 to the tip shroud 116. In this respect, cooling fluid may flow through the cooling passages 142, 144, 146, 148, 150 from the intake port 112 to the tip shroud 116. In exemplary embodiments, the cooling passages 142, 144, 146, 148, 150 may be formed via shaped tube electrolytic machining. Although, the cooling passages 142, 144, 146, 148, 150 may be formed in any suitable manner.

Figure 4:
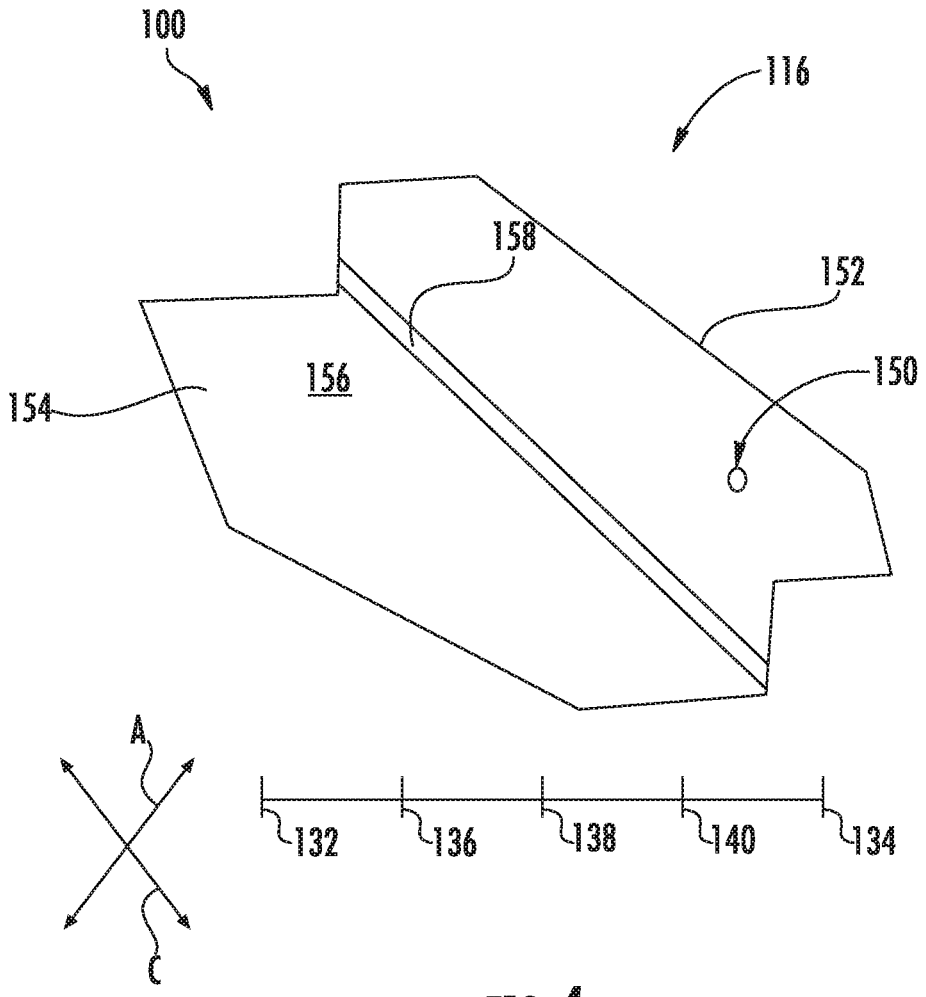
FIG. 4 is a top view of the rotor blade in accordance with the embodiments disclosed herein.

As mentioned above, the rotor blade 100 includes the tip shroud 116. As illustrated in FIGS. 2 and 4, the tip shroud 116 couples to the radially outer end of the airfoil 114 and generally defines the radially outermost portion of the rotor blade 100. In this respect, the tip shroud 116 reduces the amount of the combustion gases 34 (FIG. 1) that escape past the rotor blade 100. The tip shroud 116 includes a side wall 152 and a radially outer wall 154 having a radially outer surface 156. As shown, the tip shroud 116 may include a seal rail 158 extending radially outwardly from the radially outer wall 154. Alternate embodiments, however, may include more seal rails 158 (e.g., two seal rails 158, three seal rails 158, etc.) or no seal rails 158 at all.

Figure 5:
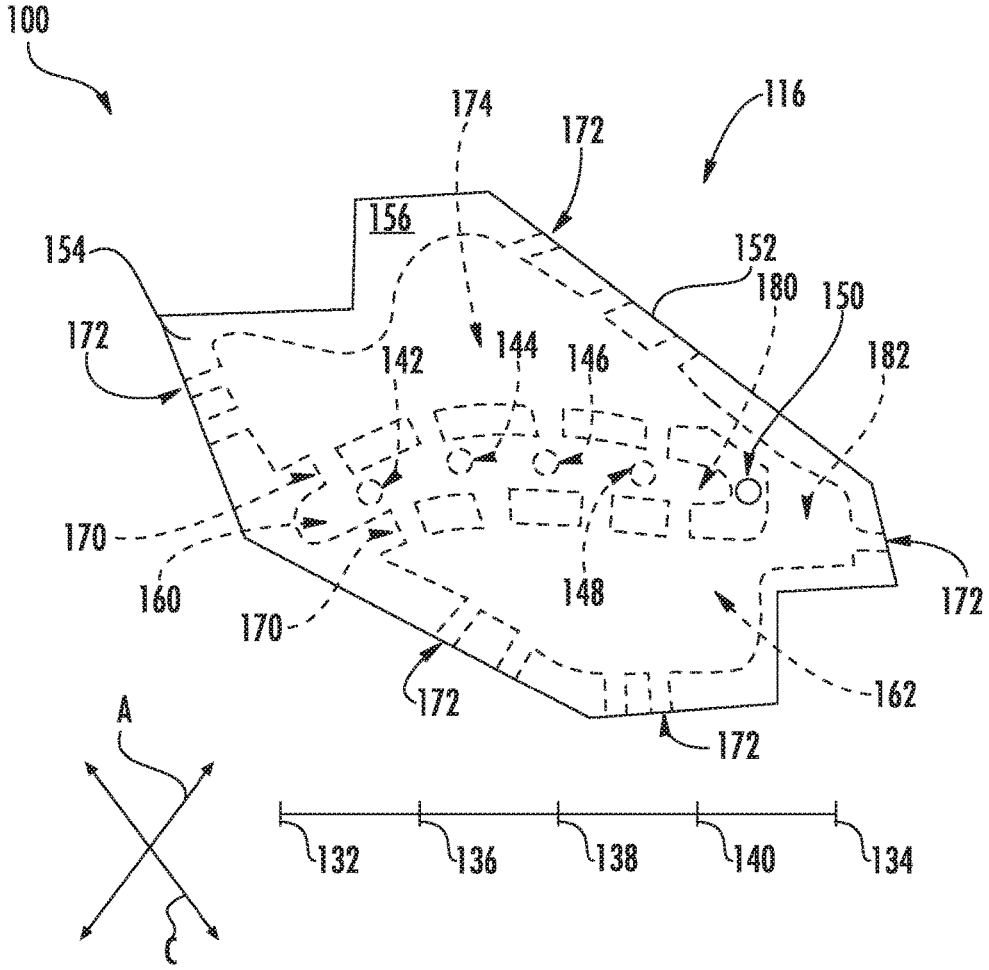
FIG. 5 is an alternate top view of the rotor blade shown in FIG. 4, illustrating a cooling cavity in accordance with the embodiments disclosed herein.

FIG. 5 is a top view of the rotor blade 100, where the seal rail 158 shown in FIG. 4 is omitted for clarity. As shown, the tip shroud 116 defines various passages, chambers, and apertures to facilitate cooling thereof. More specifically, the tip shroud 116 defines a central plenum 160. In the embodiment shown, the central plenum 160 is fluidly coupled to the cooling passages 142, 144, 146, 148 and fluidly isolated from the cooling passage 150. In alternate embodiments, however, the central plenum 160 may be fluidly coupled to or fluidly isolated from any number or grouping of the cooling passages 142, 144, 146, 148, 150 so long as the central plenum 160 is fluidly isolated from at least one of the cooling passages 142, 144, 146, 148, 150. The tip shroud 116 also defines a main body cavity 162. As shown, the main body cavity 162 may be positioned around a portion of or the entirely of the central plenum 160. One or more cross-over apertures 170 defined by the tip shroud 116 may fluidly couple the central plenum 160 to the main body cavity 162. Furthermore, the tip shroud 116 defines one or more outlet apertures 172 that fluidly couples the main body cavity 162 to the hot gas path 32 (FIG. 1). In the embodiment shown in FIG. 5, the tip shroud 116 defines eight cross-over apertures 170 and nine outlet apertures 172. In alternate embodiments, however, the tip shroud 116 may define more or fewer cross-over apertures 170 and/or outlet apertures 172. Moreover, the tip shroud 116 may define any suitable configuration of passages, chambers, and/or apertures. The central plenum 160, the main body cavity 162, the cross-over apertures 170, and the outlet apertures 172 may collectively be referred to as a core 174.

Figure 6:
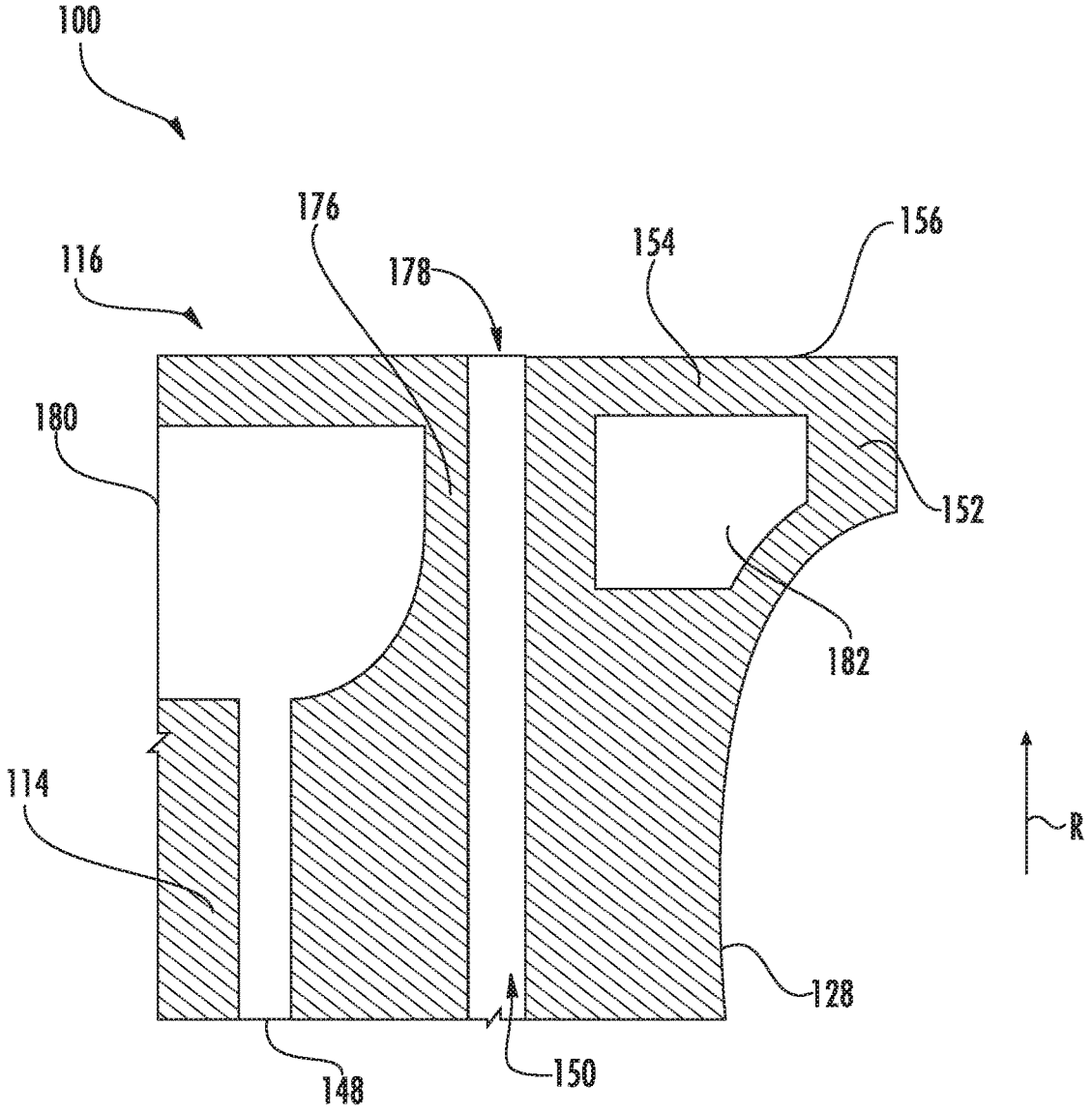
FIG. 6 is cross-sectional view of a portion of the rotor blade, illustrating a rib in the tip shroud in accordance with the embodiments disclosed herein.

As indicated above, the cooling passage 150 is fluidly isolated from the central plenum 160 and, more generally, the entire core 174. In this respect, the cooling passage 150 extends through the tip shroud 116 without intersecting any portion of the core 174 as shown in FIGS. 5 and 6. As such, the cooling passage 150 extends through a rib 176 in the tip shroud 116 and the radially outer wall 154 of the tip shroud 116. That is, the rib 176 and the radially outer wall 154 partially define the cooling passage 150. Furthermore, the radially outer surface 156 of the radially outer wall 154 defines an outlet 178 of the cooling passage 150. In this respect, the cooling fluid flowing through the cooling passage 150 bypasses the core 174 by flowing through the rib 176 and exits through the outlet 178 into the hot gas path 32 (FIG. 1).

The rib 176 separates a first portion 180 of the core 174 and a second portion 182 of the core 174. Furthermore, the core 174 may entirely circumferentially surround the rib 176. For example, the rib 176 may be positioned aft of the first portion 180 of the core 174 and forward of a second portion 182 of the core 174. In the embodiment shown in FIG. 5, the first portion 180 of the core 174 is a portion of the central plenum 160 and the second portion 182 of the core 174 is a portion of the main body cavity 162. In alternate embodiments, the first and second portions 180, 182 of the core 174 may be any suitable portions thereof.

The cooling passage 150 may extend through the rib 176 and the radially outer wall 154 at various locations. In this respect, the cooling passage 150 may be located at various positions within the airfoil 114 and the tip shroud 116. In particular embodiments, the cooling passage 150 is located proximate to the trailing edge 128 to provide cooling to the trailing edge portions of the airfoil 114. In this respect, the cooling passage 150 may be located aft of the other cooling passages 142, 144, 146, 148 as shown in FIGS. 3, 5, and 6. As illustrated in FIG. 4, the cooling passage 150 may also be positioned aft of the seal rail 158. Referring now to FIG. 5, the cooling passage 150 may be positioned entirely aft of the central plenum 160. In this respect, the cooling passage 150 may be positioned aft of fifty percent 138 of the chord 130 or aft of seventy-five percent 140 of the chord 130. In alternate embodiments, however, the cooling passage 150 may be located in any suitable position in the airfoil 114 and the tip shroud 116. In further embodiments, the cooling passage 150 may positioned forward of at least one of the cooling passages 142, 144, 146, 148.

During operation of the gas turbine engine 10, cooling fluid flows through the passages, cavities, and apertures described above to cool the airfoil 114 and the tip shroud 116. More specifically, cooing air (e.g., bleed air from the compressor section 14) enters the rotor blade 100 through the intake port 112 (FIG. 2). This cooling fluid then flows radially outward through the cooling passages 142, 144, 146, 148, 150 to the tip shroud 116, thereby convectively cooling the airfoil 114. The cooling fluid in the cooling passages 142, 144, 146, 148 flows into central plenum 160 in the tip shroud 116. This cooling fluid then flows from the central plenum 160 through the cross-over apertures 170 into the main body cavity 162. While flowing through the main body cavity 162, the cooling fluid convectively cools the various walls of the tip shroud 116, such as the side wall 152 and the radially outer wall 154. The cooling fluid may then exit the main body cavity 162 through the outlet apertures 172 and flow into the hot gas path 32 (FIG. 1).

As mentioned above, the cooling fluid flowing through the cooling passage 150 is fluidly isolated from the core 174. In this respect, the cooling fluid in the cooling passage 150 bypasses the core 174 and flows directly into the hot gas path 32. That is, the cooling fluid in the cooling passage 150 flows through the airfoil 114, the rib 176, and the radially outer wall 154 before exiting the rotor blade 100 through the outlet 178.

The cooling fluid flows at a higher velocity through the cooling passage 150 than through the cooling passages 142, 144, 146, 148. As mentioned above, the cooling passages 142, 144, 146, 148, 150 are all fluidly coupled to the intake port 112. In this respect, the pressure of the cooling fluid entering each of the cooling passages 142, 144, 146, 148, 150 is generally the same. Nevertheless, the pressure within the central plenum 160 is greater than the pressure at the radially outer surface 156 of the tip shroud 116 where the outlet 178 of the cooling passage 150 is located. As such, the pressure drop along the cooling passage 150 (i.e., between the intake port 112 and the radially outer surface 156) is greater than the pressure drop along the cooling passages 142, 144, 146, 148 (i.e., between the intake port 112 and the central plenum 160). Accordingly, the cooling fluid flows at a higher velocity through the cooling passage 150 than the cooling passage 142, 144, 146, 148 because of the greater pressure drop along the cooling passage 150.

As discussed in greater detail above, the cooling passage 150 is fluidly isolated from the core 174. In this respect, and unlike with conventional rotor blade configurations, not all of the cooling passages extending through the airfoil 114 in the rotor blade 100 are fluidly coupled to the core 174. The velocity of the cooling fluid flowing through the cooling passage 150 is not limited by the back pressure created by the outlet apertures 172. As such, the cooling fluid flows through the cooling passage 150 in the rotor blade 100 at higher velocity than through the cooling passages of conventional rotor blades. Accordingly, the cooling passage 150 provides greater cooling to the airfoil 114 than conventional cooling passages provide in conventional blades.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A rotor blade for a turbomachine, comprising:

a platform;

an airfoil extending outward in a radial direction from the platform; and a tip shroud coupled to the airfoil opposite the platform, the tip shroud defining a core, the tip shroud including a radially outer wall distal to the airfoil and a rib positioned within the core inward, in the radial direction, of the radially outer wall; wherein the rib separates a first portion of the core and a second portion of the core;

wherein the rib defines a first cooling passage fluidly isolated from the core.

2. The rotor blade of claim 1, wherein the first portion of the core is positioned forward of the rib and the second portion of the core is positioned aft of the rib.

3. The rotor blade of claim 1, wherein the first portion of the core is a central plenum and the second portion of the core is a main body cavity.

4. The rotor blade of claim 1, wherein the tip shroud comprises one or more seal rails extending radially outward from the radially outer wall, and wherein the rib is positioned aft of the one or more seal rails.

5. The rotor blade of claim 1, wherein the airfoil defines a chord extending from a leading edge to a trailing edge, and wherein the first cooling passage is positioned aft of fifty percent of the chord.

6. The rotor blade of claim 1, wherein the airfoil defines a chord extending from a leading edge to a trailing edge, and wherein the first cooling passage is positioned aft of seventy-five percent of the chord.

7. The rotor blade of claim 1, wherein the radially outer wall includes a radially outer surface, and wherein the radially outer surface defines an outlet of the first cooling passage.

8. The rotor blade of claim 1, wherein the airfoil and the tip shroud define a second cooling passage fluidly coupled to the core.

9. The rotor blade of claim 8, wherein the second cooling passage is positioned forward of the first cooling passage.

10. The rotor blade of claim 1, wherein the core entirely circumferentially surrounds the rib.

11. A turbomachine, comprising:

a compressor section;

a combustion section; and a turbine section including one or more rotor blades, each rotor blade comprising:

a platform;

an airfoil extending outward in a radial direction from the platform; and a tip shroud coupled to the airfoil opposite the platform, the tip shroud defining a core, the tip shroud including a radially outer wall distal to the airfoil and a rib positioned within the core inward, in the radial direction, of the radially outer wall; wherein the rib separates a first portion of the core and a second portion of the core;

wherein the rib defines a first cooling passage fluidly isolated from the core.

12. The turbomachine of claim 11, wherein the first portion of the core is positioned forward of the rib and the second portion of the core is positioned aft of the rib.

13. The turbomachine of claim 11, wherein the first portion of the core is a central plenum and the second portion of the core is a main body cavity.

14. The turbomachine of claim 11, wherein the airfoil defines a chord extending from a leading edge to a trailing edge, and wherein the first cooling passage is positioned aft of fifty percent of the chord.

15. The turbomachine of claim 11, wherein the airfoil defines a chord extending from a leading edge to a trailing edge, and wherein the first cooling passage is positioned aft of seventy-five percent of the chord.

16. The turbomachine of claim 11, wherein the radially outer wall includes a radially outer surface, and wherein the radially outer surface defines an outlet of the first cooling passage.

17. The turbomachine of claim 11, wherein the airfoil and the tip shroud define a second cooling passage fluidly coupled to the core.

18. The turbomachine of claim 17, wherein the second cooling passage is positioned forward of the first cooling passage.

19. The turbomachine of claim 11, wherein the core entirely circumferentially surrounds the rib.

20. A rotor blade for a turbomachine, comprising:

a platform;

an airfoil extending outward in a radial direction from the platform; and a tip shroud coupled to the airfoil opposite the platform, the tip shroud defining a core, the tip shroud including a radially outer wall distal to the airfoil and a rib positioned within the core such that the rib separates a first portion of the core and a second portion of the core, the rib defining a cooling passage fluidly isolated from the core.

* * * * *